US008157814B2

(12) United States Patent
Kelsey et al.

(10) Patent No.: US 8,157,814 B2
(45) Date of Patent: Apr. 17, 2012

(54) APPLIANCE

(75) Inventors: Steven Frederick Kelsey, London (GB); Angela Caroline Morris, Morden (GB)

(73) Assignee: Reckitt Benckiser (UK) Limited, Sough, Berkshire (GB)

( * ) Notice: Subject to any disclaimer, the term of this patent is extended or adjusted under 35 U.S.C. 154(b) by 783 days.

(21) Appl. No.: 10/311,831

(22) PCT Filed: Jun. 26, 2001

(86) PCT No.: PCT/GB01/02799

§ 371 (c)(1),
(2), (4) Date: May 6, 2003

(87) PCT Pub. No.: WO02/00059

PCT Pub. Date: Jan. 3, 2002

(65) Prior Publication Data

US 2003/0200619 A1 Oct. 30, 2003

(30) Foreign Application Priority Data

Jun. 28, 2000 (GB) ..... 0015774.3

(51) Int. Cl.
*A61B 17/50* (2006.01)

(52) U.S. Cl. ..... 606/131; 606/133

(58) Field of Classification Search ..... 606/131, 606/133, 161, 9; 604/289, 290, 293, 1; 132/73, 132/75.6, 76.4, 320, 221; 19/2; 435/265; 15/93.1, 236.01–236.04, 236.05, 245, 245.1; D32/46; D28/7, 44, 44.1; D7/688
See application file for complete search history.

(56) References Cited

U.S. PATENT DOCUMENTS

| | | | | | |
|---|---|---|---|---|---|
| 269,793 | A | * | 12/1882 | Keene | 119/623 |
| D119,329 | S | * | 3/1940 | Leyne | D28/36 |
| 2,233,811 | A | * | 3/1941 | Doty | 604/289 |
| 2,715,745 | A | * | 8/1955 | Jacobsen | 15/121 |
| 4,078,865 | A | | 3/1978 | Moser | 401/23 |
| 4,364,142 | A | | 12/1982 | Pangle | 15/117 |
| 4,461,285 | A | * | 7/1984 | Courtin | 601/137 |
| 4,473,944 | A | | 10/1984 | Carroll | 30/41 |
| 4,893,641 | A | * | 1/1990 | Strickland | 132/200 |
| 4,981,682 | A | * | 1/1991 | Boothroyd et al. | 424/70.5 |
| 5,217,475 | A | * | 6/1993 | Kuber | 606/161 |

(Continued)

FOREIGN PATENT DOCUMENTS

| | | |
|---|---|---|
| CA | 2198404 | 8/1998 |

(Continued)

OTHER PUBLICATIONS

PCT International Search Report, dated Dec. 17, 2001, for PCT/GB01/02799.
GB Search Report, dated Oct. 24, 2000, for GB 0015774.3.
Derwent Abstract Access No. 1982-E0920E for DE 3031131 A.
Derwent Abstract Access No. 1990-001711 for ES 2009263 A.
WPI Abstract Acc No. 1998-431205 and JP 10179445.

*Primary Examiner* — Kathleen Sonnett
(74) *Attorney, Agent, or Firm* — Norris McLaughlin & Marcus PA

(57) ABSTRACT

A spatula for depilatory use comprises a generally S-section flexible plastics body 4, a straight elastomeric fin 10 at one end, and at the other end, an elastomeric fin of "fish-tail" shape. The straight fin can remove a depilatory preparation from most areas of the skin, and the other fin is able to remove the preparation from less accessible areas. The elastomeric fins give effective hair removal while avoiding the deleterious effects of earlier scrapers.

8 Claims, 1 Drawing Sheet

U.S. PATENT DOCUMENTS

| | | | | | |
|---|---|---|---|---|---|
| 5,239,725 | A | * | 8/1993 | White | 15/105.5 |
| 5,349,716 | A | * | 9/1994 | Millar | 15/245 |
| D362,934 | S | * | 10/1995 | Hansen | D32/41 |
| 5,690,057 | A | * | 11/1997 | Curry | 119/623 |
| 5,706,553 | A | * | 1/1998 | Riley et al. | 16/111.1 |
| 5,810,856 | A | * | 9/1998 | Tveras | 606/161 |
| 5,928,254 | A | * | 7/1999 | Jensen | 606/161 |
| 6,056,763 | A | * | 5/2000 | Parsons | 606/161 |
| 6,094,594 | A | * | 7/2000 | Tapper | 604/20 |
| 6,099,540 | A | * | 8/2000 | Ho | 606/161 |
| RE37,190 | E | * | 5/2001 | Stowell et al. | 16/422 |
| 6,451,038 | B2 | * | 9/2002 | Rosenblood et al. | 606/161 |
| 6,880,198 | B1 | * | 4/2005 | Hazard | 15/235.7 |

FOREIGN PATENT DOCUMENTS

| | | |
|---|---|---|
| DE | 3031131 | 4/1982 |
| ES | 2 009 263 | 9/1989 |
| GB | 333028 | 8/1930 |
| GB | 338666 | 11/1930 |
| GB | 785902 | 11/1957 |
| GB | 2 193 431 | 2/1988 |
| GB | 2 295 534 A | 6/1996 |

* cited by examiner

APPLIANCE

This invention relates to a spatula for personal use, particularly for depilatory use.

In a depilatory method a preparation is applied to the skin, in order to degrade the hair growing from the skin. The preparation and hair may be removed without any mechanical assistance, for example by showering. This method is kind to the skin but tends to be imperfect in respect of hair removal.

An alternative method is to remove the preparation and hair by means of a spatula, used in the manner of a scraper or strigil. The scraping action of the spatula helps to remove those hairs which have been incompletely degraded by the preparation. Thus, hair removal is very effective. However, the scraping action can lead to skin coarsening and roughness.

Existing spatulas which have this effect are composed entirely of hard plastics materials, terminating in a scraper head.

There is a need for a spatula for the purpose stated above, and which is able to achieve efficient removal of the hair-degrading preparation and hair, but which is less aggressive to the skin across which it is to be drawn.

In accordance with the first aspect to the present invention there is provided a spatula adapted for the removal of a preparation applied to the skin, the spatula comprising a body portion to be held, in use, by a user, the body portion comprising a plastics sheet capable of being elastically flexed and a fin adapted to remove the preparation from the skin, the fin projecting beyond the body portion, and being of an elastomeric material.

In principle the preparation to be removed could be any cosmetic preparation, but is preferably a preparation formulated for the weakening or removal of hair from human skin. Thus, the spatula of the invention preferably effects removal of a hair-degrading preparation applied to the skin, and of hair itself.

By hair-degrading preparation we mean any composition—wax, gel, cream or other—which breaks, thins or otherwise weakens hair.

Preferably the fin has a straight edge.

Preferably the spatula is a generally elongate body, and the fin is located at one end thereof.

The fin may have a plurality of parallel edges which make contact with the skin at spaced-apart positions. Thus, the fin may be stepped or ridged. Preferred is a fin with one skin-contacting edge, or a fin with two skin-contacting parallel edges.

Preferably, in terms of the shape of the spatula the fin is a continuation of the body portion. The spatula is preferably manufactured by a co-moulding process. Preferably the thickness of the body portion is less than 3 mm, more preferably less than 2 mm.

At the junction of the plastics material and the elastomeric material which constitutes the fin, the latter may be moulded around the former, or the former around the latter. The plastics material may thus provide some structural support to the fin. Alternatively it may be perfectly adequate if there is face-to-face contact between the plastics material and the elastomeric material which constitutes the fin.

Preferably the fin extends not more than 5 mm beyond the body portion, preferably not more than 4 mm.

When, as is preferred, the spatula is of elongate form and has a said fin at one end of it (hereinafter the "first fin", at the "first end"), it preferably has a second fin able to remove a preparation from the skin, at the other end (the "second end") of the spatula, the second fin also being of an elastomeric material.

Preferably the body portion is substantially entirely constituted by the non-elastomeric plastics material. An elastomeric fin is only at one end, or at both ends. In an alternative embodiment the spatula has a sandwich structure, with an elastomeric sheet sandwiched between two sheets of a more rigid plastics material and extending beyond it at one or both ends, to provide a fin or fins. The two plastics sheets together define the flexural characteristics of the body portion. In another embodiment an elastomeric material surrounds a stiffer plastics sheet, which reinforces the elastomeric material. The elastomeric material may extend beyond the plastics sheet, forming a fin, at one end, or both ends, or all round the plastics sheet. The plastics sheet defines the flexural characteristics of the body portion in such an embodiment.

The second fin may have a plurality of parallel edges which make contact with the skin at spaced-apart positions. Thus, the second fin may be stepped or ridged. Preferred is a second fin with one skin-contacting edge, or a fin with two skin-contacting edges.

Preferably the second end of the spatula is of different shape to the first end. Preferably it is not of straight-line form. Preferably it is curved, preferably somewhat indented or convex. Most preferably it is of "fish-tail" shape. Preferably the "fish-tail" ends thereof are themselves curved. Thus, the second end may have two somewhat lobe-shaped portions which can be used for removing a preparation from an awkward location, such as an armpit.

The elastomeric material of the second fin may be moulded around the plastics material of the body portion, or vice-versa, at their junction. The plastics material may thus provide some structural support to the second fin. Alternatively it may be perfectly adequate if there is face-to-face contact between the plastics material and the elastomeric material which constitutes the second fin.

Preferably the second fin extends not more than 5 mm beyond the body portion, preferably not more than 4 mm, Preferably the spatula is not flat, but curves, at least in the region of the adjoining fin. Preferably it has a convex portion and, facing in the opposite direction, a complementary concave portion. In use, the user will usually orient the concave portion adjoining the fin to face the skin. Preferably the other end of the spatula curves in the opposite sense. Preferably, the spatula is a flattened S-shape, in longitudinal cross-section, in other words an S-shape notionally elongated in the direction from one end of the "S" to the other.

Preferably, the or each concave portion of the spatula is formed with a transverse ridge, to aid grip and/or act as a barrier to the preparation and/or aid stacking of spatulas.

Preferably the spatula is a small article not longer than 20 cm, and more preferably not longer than 12 cm, at its longest. Preferably it is not wider than 7 cm, and more preferably not wider than 5.5 cm, at its widest.

Preferably the spatula does not have a handle projecting from the body portion; the body portion is itself held, in use.

In accordance with a second aspect of the present invention there is provided a method of removing a preparation from human skin, using a spatula of the first aspect of the present invention. Preferably the preparation is a hair-degrading preparation, and the method is a depilatory method.

The invention will now be further described, by way of example, with reference to the accompanying drawings in which.

Figure 1:
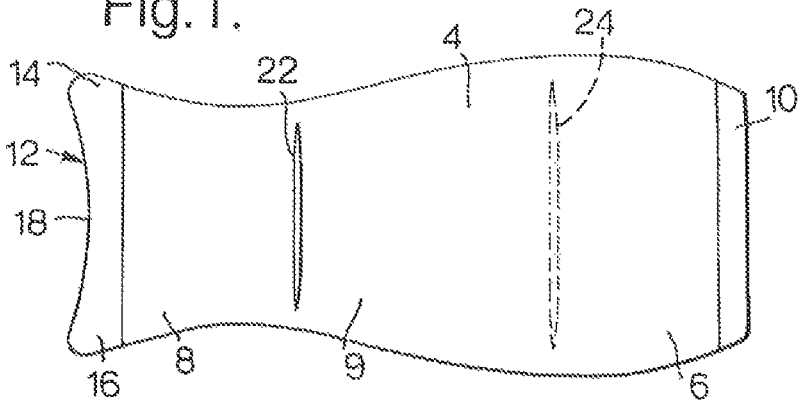
FIG. 1 shows a spatula in accordance with the present invention, in plan view.
Figure 2:
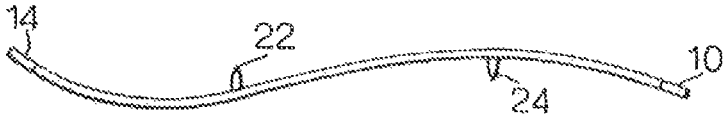
FIG. 2 shows the spatula of FIG. 1 in side view.

With reference to FIGS. 1 and 2, the spatula shown is of somewhat elongate shape. It has a body portion 4 of a plastics material, hard but sufficiently thin to be able to flex elastically. The body portion is made up of a head portion 6, a tail portion 8, and between them, a middle, waisted, region 9.

The head portion 6 terminates in an elastomeric fin 10. The fin extends, straight, from one side of the spatula to the other.

The tail portion of the spatula terminates in an elastomeric fin 12. The tail portion 8 is of "fish-tail" shape, and this shape is matched by the fin 12. The fin 12 may be seen as having distinct lobes 14, 16, and an inwardly curved region 18 between them.

As will be seen in FIG. 2, the spatula is curved from one end to the other, first in one sense, then in the opposite sense. Accordingly its shape may be regarded as being like a flattened "S" in longitudinal cross-section. It is formed with two ridges 22, 24, one extending into each concave region, each ridge being transverse to the length of spatula.

Figure 3:
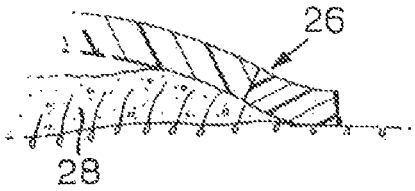
FIG. 3 shows in side sectional view one end of the spatula of FIG. 1, removing a hair-degrading preparation, and hair, from human skin.

As will be seen in FIGS. 2 and 3, in this embodiment the fins 10, 18 terminate in a plain end, and so each fin makes contact with the skin at one position, at any given time.

At its junction 26 with the body portion each fin makes face-to-face contact with the body portion.

The spatulas of this invention may be made by a bi-injection moulding process. In another embodiment a sandwich structure could be employed, with an elastomeric sheet being sandwiched between two sheets of a more rigid plastics material, and extending beyond it, to provide a fin, or fins.

In another embodiment an elastomeric material could be moulded around a plastics stiffener sheet, extending beyond it to provide a fin, or fins.

In use a depilatory cream, shown as 28 in FIG. 3, is applied to the skin from which it is desired to remove hair. The cream will generally degrade the hair to the extent that some hairs are broken, and the remainder weakened. A spatula described above is used to complete the process, removing cream from the skin, along with broken hairs, and at the same time breaking off weakened hairs, and removing those. Generally the straight fin 10 is used. It is drawn across the skin as shown in FIG. 3 with the adjacent concave portion facing towards the skin. The other end of the spatula is used to remove the cream and hair from places which are not well contacted by the straight fin 10, for example armpits, and the backs of knees.

Figure 4:
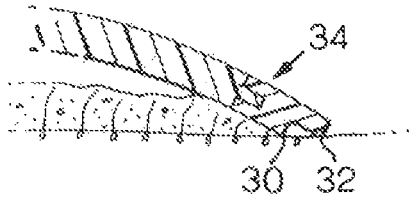
FIG. 4 shows in side sectional view the corresponding end of a second embodiment of spatula removing a hair-degrading preparation, and hair, from human skin.

In the embodiment of FIG. 4 each fin (of which one is shown) has two discrete steps 30, 32 able to make simultaneous contact with skin during the removal operation.

A further difference is that in the FIG. 4 embodiment each fin is moulded around the respective edge of the plastics material of the body portion, forming a tongue-and-groove junction 34.

Figure 5:
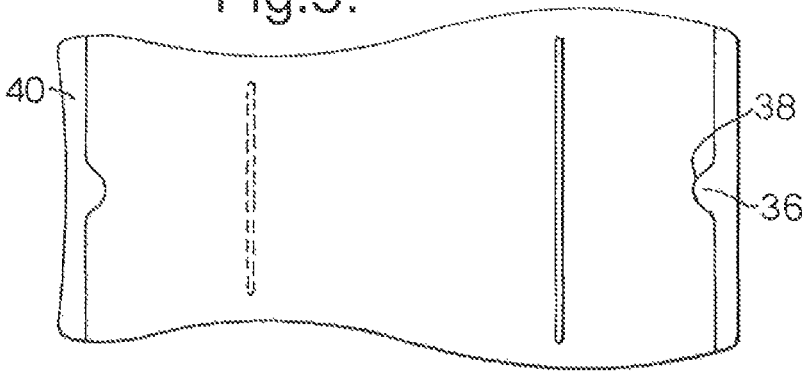
FIG. 5 shows in plan view a third embodiment of spatula.
Figure 6:
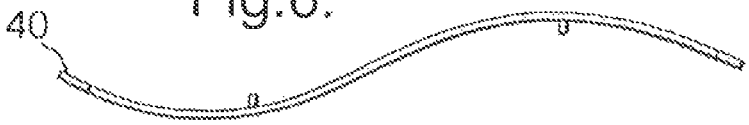
FIG. 6 shows in side view the spatula of FIG. 5.

In FIGS. 5 and 6 a third embodiment is shown. This differs from the first embodiment in the following respects:

Its curvature is greater—compare FIG. 6 with FIG. 2.

Its elastomeric fins 38, 40 are thicker, and stiffer. They can only be bent over on application of a considerable force, whereas the fins of the first embodiment can be bent over much more easily.

Each fin has a tongue 36 in a notch 38 in the adjoining edge of the body portion. This improves contact beneath the respective fin and the body portion, as well as having an aesthetic benefit.

The trailing fin 40 is slightly convex but has a less pronounced "fish tail" shape that the corresponding fin of the first embodiment.

Nevertheless the spatula of the third embodiment functions in the same way as the spatula of the first embodiment.

The invention claimed is:

1. A spatula adapted for the removal of a preparation applied to skin, the spatula comprising:

a generally elongate body portion to be held, in use, by a user, the body portion having a length defined between a first end and a second end and a thickness defined between a top side and a bottom side, wherein the thickness of the body portion is less than 3 mm, wherein the body portion comprises a plastics sheet capable of being elastically flexed and has a longitudinal cross-section comprising a flattened single S-shape extending from the first end of the body portion to the second end of the body portion which flattened S-shape defines first and second convex portions and a complementary first and second concave portions;

a first ridge extending into the first concave portion and being transverse to the length of the body portion;

a second ridge extending into the second concave portion and being transverse to the length of the body portion;

a first fin projecting along and beyond the first end of the body portion, wherein the first fin is a continuation of the body portion and has a first edge adjacent to the body portion and a second edge located opposite to the first edge of the first fin, wherein the first fin extends outwardly from the first end of the body portion; and a second fin projecting along and beyond the second end of the body portion, wherein the second fin is a continuation of the body portion and has a first edge adjacent to the body portion and a second edge located opposite to the first edge of the second fin, wherein the second fin extends outwardly from the second end of the body portion, wherein the fins are adapted to remove the preparation from the skin and are made of an elastomeric material, wherein the second edge of the first fin is straight and the second edge of the second fin is a fish-tail shape having a first lobe connected to a second lobe via a region curved inwardly with respect to the first edge of the second fin, wherein the plastics sheet and the elastomeric material are different materials.

2. A spatula according to claim 1 wherein the second edge of both the first fin and the second fin has at least one skin contacting edge.

3. A spatula according to claim 1 adapted for the removal of a depilatory preparation applied to the skin.

4. A spatula according to claim 1, wherein a length of the first and second fins is not more than 5 mm.

5. A spatula according to claim 1, wherein the body portion has a width defined between a first side and a second side, wherein the width of the body portion is less than 7 cm and the length of the spatula is less than 20 cm.

6. A method of removing a hair degrading preparation from human skin, comprising the steps of:

providing a spatula as claimed in claim 1, and drawing the spatula across the human skin to remove the hair degrading preparation from the human skin.

7. The method as claimed in claim 6, wherein the preparation is a depilatory preparation.

8. A method of using a spatula as claimed in claim 6 wherein the hair degrading preparation is a wax, gel, cream or other composition which breaks, thins or otherwise weakens hair.

* * * * *